US005291750A

United States Patent [19]

Parrish et al.

[11] Patent Number: 5,291,750

[45] Date of Patent: Mar. 8, 1994

[54] INNOVATION ADSORPTION HEATING AND COOLING DEVICE FOR MICRO-CLIMATE APPLICATIONS

[75] Inventors: Clyde F. Parrish, Melbourne; Robert P. Scaringe, Rockledge, both of Fla.

[73] Assignee: Mainstream Engineering Corporation, Rockledge, Fla.

[21] Appl. No.: 832,035

[22] Filed: Feb. 6, 1992

[51] Int. Cl.[5] ..... F25D 23/12

[52] U.S. Cl. ..... 62/259.3; 62/480; 62/106; 165/104.12

[58] Field of Search ..... 62/480, 478, 106, 259.3, 62/101, 102, 104, 109, 110, 111; 165/104.12

[56] References Cited

U.S. PATENT DOCUMENTS

| | | | |
|---|---|---|---|
| 2,024,083 | 12/1935 | Young | 62/480 |
| 4,610,148 | 9/1986 | Shelton | 62/480 |
| 4,881,376 | 11/1989 | Yoneyawa et al. | 62/480 |

*Primary Examiner*—John M. Sollecito

*Attorney, Agent, or Firm*—Evenson, McKeown, Edwards & Lenahan

[57] ABSTRACT

A micro-climate heating/cooling method and apparatus for vests and the like operates with reaction of working fluid, such as water, with an adsorbent material. A light-weight pump is the only moving component needed to provide the desired heating and cooling requirements.

5 Claims, 1 Drawing Sheet

EVAPORATOR WITH PUMP TO VEST

INNOVATION ADSORPTION HEATING AND COOLING DEVICE FOR MICRO-CLIMATE APPLICATIONS

CROSS-REFERENCE TO RELATED APPLICATIONS

This application is related to application Ser. No. 07/593,044, filed on Oct. 5, 1990 and to application Ser. No. 07/660,996, filed on Feb. 26, 1991.

BACKGROUND AND SUMMARY OF THE INVENTION

The present invention relates to a micro-climate heating and cooling method and to a device that is lightweight, needs only a small, battery-operated pump as the only moving component, and is regeneratable. More particularly, the present invention relates to a system and method in which heating or cooling is generated by reaction of water vapor or other working fluid with an adsorbent material and which does not require the use of refrigeration to keep phase-change material cold. The present invention is especially appropriate for micro-climate cooling and heating of soldiers wearing NBC overgarments, cooling systems for firefighters, nuclear power workers, foundry workers, and construction workers, and for a passive cooling system used by race car drivers and configured to be lighter than the currently used ice water cooling systems.

The passive cooling approach available up to now has been the use of a phase change material that "melts" and adsorbs body heat as shown in U.S. Pat. No. 4,856,294. Passive methods have not, however, generally been used for heating. Heating can be accomplished by use of a phase change material that is melted so as to provide heat to the body by recrystallization. Although this heating approach works, the weight penalty becomes prohibitive for heating or cooling times greater than one hour and is, therefore, unacceptable for long periods of use.

An active refrigeration system is known for cooling in which a fuel is used to power an active air conditioning system. More specifically, a vapor-compression-type system is used in which the fuel powers an engine to provide shaft work which, in turn, drives a compact vapor-compression-air conditioning system, thereby achieving the cooling. Such a system is superior to Stirling or Brayton cycle approaches in terms of efficiency and weight. Today's technology for the internal combustion power source dictates, however, an approximate engine mass of 3 pounds, which consumes approximately 6 pounds of fuel during a 6-hour cooling period. In addition, all of these known active systems produce an unacceptable level of noise due to the engine.

It is, therefore, an object of the present invention to solve the problems of weight, noise, and the like for heating and cooling requirements which exceed short periods of time, i.e. periods in excess of one hour and up to about six hours.

These problems have been solved in accordance with the present invention by the utilization of a body temperature control system that is regeneratable and uses a lightweight, battery-operated circulating pump as the only moving component to provide both the heating and the cooling requirements. Two heat exchangers are used, one in the water reservoir for cooling and a second in the adsorption bed for heating.

Inasmuch as a heating or cooling requirement is not continuous but instead is only needed for six hours due primarily to protective capacity time constraints, an intermittent air conditioner in accordance with the present invention offers improved mass, noise, and reliability features.

One presently contemplated embodiment of the present invention includes a water-filled vest for both heating and cooling. The vest is configured with a small battery-operated circulating pump for either the heating system or the cooling system. The systems can supply up to 300 watts of cooling or 540 watts of heating for a period of up to six hours as maximum design requirements. The user-controlled needle valve is used to control a vest temperature, even under varying heating or cooling requirements, up to the maximum design cooling requirement of 300 watts or maximum design heating requirement of 540 watts for six hours. After the six-hour heating or cooling period, the backpack is removed and recharged on a recharge stand by heating either electrically with, for example, resistance heaters/multiple voltage operation or by using fuel in a ceramic-wick, e.g. a kerosene heater-type configuration. The fuel for the ceramic wick is, for example, a JP-8-type kerosene fuel. Of course, the present invention can also be used in either types of clothing, e.g. gloves, without departing from its inventive principles.

Another advantage of the present invention in the form of a personal heating/cooling device resides in the fact that only one moving part is needed, namely, a battery-operated circulating pump. The cooling system evaporates the water from a sealed reservoir and captures this water in an adsorption bed that rejects heat to the environment. The rate of adsorption of water vapor on the bed is very fast, and a user-controlled needle valve between the water reservoir and the adsorption bed controls the evaporation to maintain the desired amount of cooling or heating. A heat exchanger in the water reservoir cools the circulating water in the water-vest heat exchanger. The heating system adsorbs water onto the desiccant bed and then pumps the heat generated through a heat exchanger to a water-vest heat exchanger.

BRIEF DESCRIPTION OF THE DRAWING

These and other objects, features and advantages of the present invention will become more apparent from the following detailed description of a currently preferred embodiment when taken in conjunction with the accompanying schematic figure of a micro-climate adsorption heating/cooling system with a heat exchanger used in vests and the like.

DETAILED DESCRIPTION OF THE DRAWING

Figure 1:
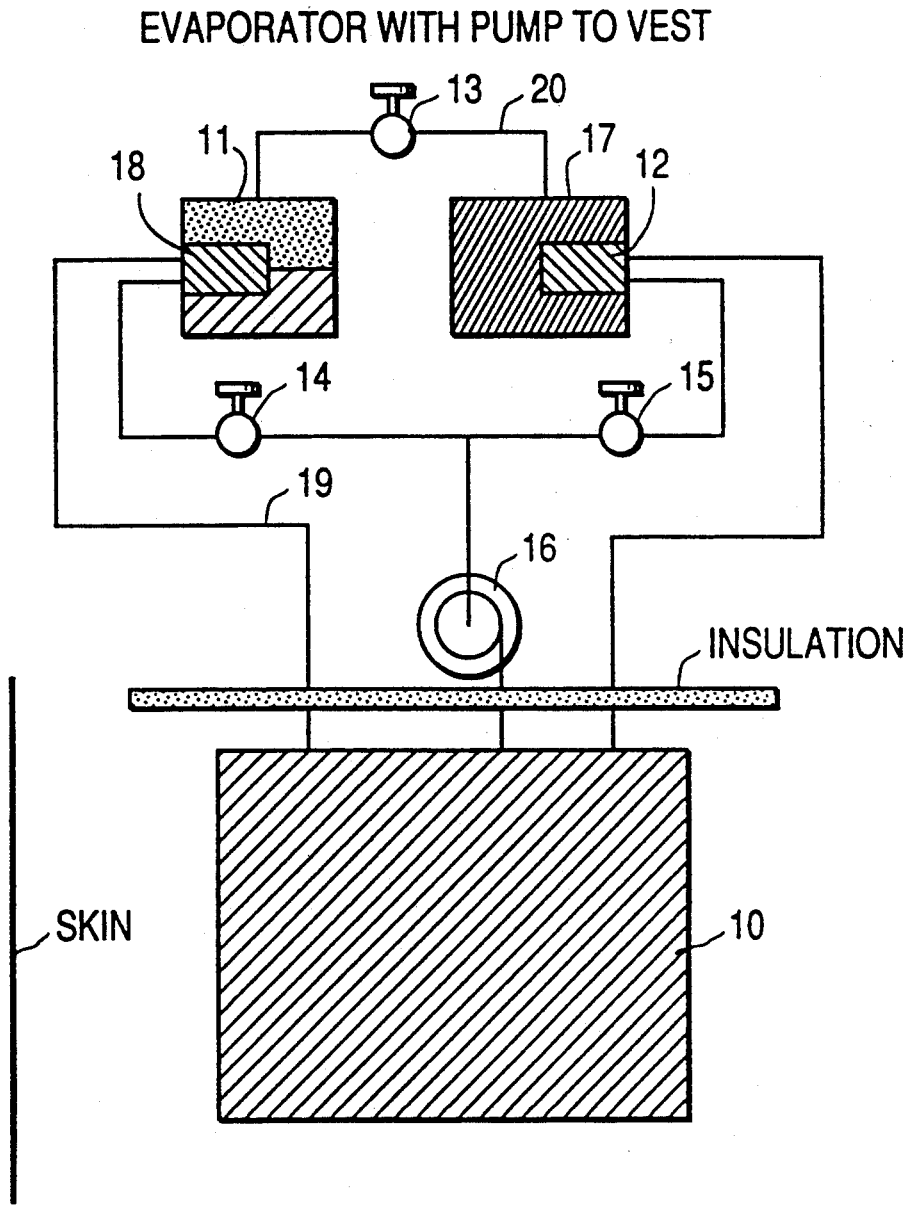

The sole figure shows the system as part of a person's water-filled vest designated generally by numeral 10 which is adjacent the person's skin and covered by an insulation layer of known construction, water reservoir evaporator 11, a backpack heat exchanger 12, a first valve 13, a second valve 14, a third valve 15, a circulating pump 16, a finned adsorption bed 17, and an evaporator heat exchanger 18.

The system can be cycled between heating and cooling by directing the flow of water through a fluid circuit 19 which passes through the vest 10 to heat exchanger 18 for cooling by opening valve 14 and closing valve 15 or for heating by directing the flow through the fluid circuit 19, the vest 10 to the heat exchanger 12 by opening the valve 15 and closing the valve 14.

A water reservoir evaporator 11 is completely filled with liquid, e.g., water, and as the vest system 10 absorbs heat from the person's body, water is pumped by the pump 16, via open valve 14, through the fluid circuit 19 to the evaporator heat exchanger 18. This heat evaporates the working liquid, e.g., water in the reservoir evaporator 11. The vaporized water is then transported from the evaporator 11, via open valve 13, through the fluid circuit 20 to the adsorption bed 17 by a pressure difference existing between the evaporator 11 and the bed 17. The adsorbent bed pressure maintains the desired pressure in the evaporator 11, which pressure is determined based on the desired temperature in the vest and the saturated pressure-temperature relationship of the particular working fluid. In the case where the working fluid is water and the desired temperature is 50° F., which is 46° F. below the normal body skin temperature, then the maximum adsorption bed pressure is 4.2 kPa (0.6 psia) in the evaporator 11. This pressure also establishes the maximum capacity of the adsorption bed 17. For example, the capacity would be approximately 23% with molecular sieve 4A having a bed pressure of 0.1 psia at 50° F. The adsorption bed 17 is configured such that the vapor pressure below the maximum pressure is always maintained as long as the bed is not saturated.

The heat exchanger 12 is configured as a parallel passage heat exchanger of generally known construction. The volume of water necessary for the system is determined by the total cooling requirement; i.e., cooling rate multiplied by cooling time. For one application, 300 watts of cooling for 6 hour results in a total cooling requirement of 6,480 kJ, which would require 2.64 kg (5.81 lbs.) of water.

In the heating cycle of the illustrated embodiment when the valve 14 is closed and the valve 15 is open, water is adsorbed on the adsorbent bed 17 from the water reservoir evaporator 11. The adsorption process liberates the heat of adsorption (1800 BTU/lb for water on molecular sieves 4A) resulting in net heating of 1800 BTU/lb of water and a heating capacity of approximately 180% of the cooling capacity, or 540 watts. This is acceptable for most of the above-mentioned applications because the total heating needs are larger than the cooling needs.

The vest can be manufactured in a known manner with multiple small passages connected in parallel to a lower-liquid and upper-vapor manifold. This construction does not need to be illustrated because, per se, it does not form part of the present invention. These passages can then be sandwiched in a cloth garment to form a vest, or, more preferably, the vest can be configured, again in a generally known manner, as a continuous flexible impervious material such as polyethylene or polyvinyl chloride to reduce complexity and the manufacturing cost.

The adsorption bed 17 is configured and sized to accommodate the total volume of the working fluid vapor which exits the water reservoir evaporator 11 during operation. A typical adsorption material is magnesium chloride (molecular weight 95) which forms a hexahydrate (molecular weight 203). The adsorption of working fluid vapor is exothermic so this bed 17 will reject heat to the environment for cooling the wearer or will pump the heat, via the battery-operated pump 16 to the vest 10 for heating the wearer. The bed 17 can be finned to promote natural convection cooling and avoid the need for forced convection. Approximate exemplary dimensions of the backpack are 12" wide×12" high and 4 to 6" deep.

A liquid accumulator (not shown) can be arranged between the evaporator 11 and the adsorption bed 17 for both heating and cooling. The accumulator prevents liquid from entering the bed 17 during transient temporary tilting of the system such as, for example, when the wearer bends over. Other more sophisticated valves, which would sense tilting and shut the system off, are not necessary although they could be used with the present invention without departing from its principles. The liquid accumulator is placed, for example, between the water reservoir evaporator 11 and the user-operated needle valve 13 at a high point on the back and plumbed so that the liquid returns to the reservoir 11. Because the vapor flow rates are very low, a separate liquid return line to the reservoir 11 is not presently considered necessary; instead, the liquid should be able to gravity-flow back to the reservoir 11 counter-currently in the vapor line. A second line can be used, however, if entrainment of this liquid is deemed a problem. In the heating cycle, the working fluid is pumped through the heat exchanger 12 in the adsorption bed 17 and then through the vest 10 which acts as a heat exchanger to transfer heat to the wearer's skin.

There are two types of pumps 16 that can be used for the present invention: (1) a battery operated pump, and (2) a open-cycle gas turbine pump. An electric pump requires only a small power source, since the energy demand of the pump is in the range of 3 to 5 watts. The open cycle gas turbine pump system uses the heat of adsorption to provide the needed power for the turbine. The water needed for the turbine system is added to a reservoir after the bed is recharged.

By way of example, the mass of a typical system can be approximately as follows:

| | |
|---|---|
| Water | 5.81 lbs |
| Adsorbent | 5.41 lbs |
| Vest & plumbing (empty) | 2.09 lbs |
| Backpack shoulder harness & straps | 0.75 lbs |
| Finned backpack absorber chamber | 1.43 lbs |
| Accumulator, control valve | 0.20 lbs |
| Total (max weight) | 15.69 lbs |

The system is recharged by the wearer removing the vest 10 and backpack and placing them on a recharge stand. This stand can consist of a heat source that is fuel fired, such as a ceramic-wick heater or is electrically heated, i.e., resistance heating. Natural circulation is used to heat the bed and drive the vapor off the bed. The system is disconnected and recharged separately. The bed is recharged in the recharge stand very quickly because the recharge time is not limited by condensation of the water-vapor which is driven off. Quick-disconnects, which automatically seal the plumbing lines, can be incorporated into both the backpack and the vest or other clothing items for simplification of the recharging process.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A heating/cooling system comprising a working fluid reservoir evaporator, a first heat exchanger operatively associated with the evaporator for cooling, an adsorption bed operatively connected with the evaporator to receive controlled amounts of working fluid vapor, a second heat exchanger operatively associated with the adsorption bed for heating, valves operatively associated with the first and second the exchangers for selectively cycling between the heating and cooling by the system, and, wherein a pump is operatively arranged with respect to the first and second heat exchangers to pump a second fluid thereto and therefrom to a location where one of heating and cooling is selectively desired and the location is a third heat exchanger arranged in a garment adapted to be worn by a person.

2. The system according to claim 1, wherein the values are configured such that one valve is open and another valve is closed during heating, and the one valve is closed and the another valve is opening cooling.

3. The system according to claim 2, wherein an additional valve is operatively arranged between the evaporator and the adsorption bed for controlling temperature of the system via control of evaporation of the working fluid.

4. The system according to claim 3, wherein the additional valve is a needle valve controlling by the person wearing the garment.

5. A heating/cooling system comprising a working fluid reservoir evaporator, a first heat exchanger operatively associated with the evaporator for cooling, an adsorption bed operatively connected with the evaporator to receive controlled amounts of working fluid vapor, a second heat exchanger operatively associated with the adsorption bed for heating, valves operatively associated with the first and second heat exchangers for selectively cycling between the heating and cooling by the system, and, wherein the adsorption bed is configured to be rechargeable, the evaporator and adsorption bed are constructed and sized to provide about 300 watts of cooling and about 540 watts of heating for up to about six hours, a pump is operatively arranged with respect to the first and second heat exchangers to pump a second fluid thereto and therefrom to a location where one of heating and cooling is selectively desired, and the location is a third heat exchanger arranged in a garment adapted to be worn by a person.

* * * * *